United States Patent [19]

Walker

[11] 4,170,858

[45] Oct. 16, 1979

[54] RESILIENT RUNNER FOR WALL CONSTRUCTION

[75] Inventor: Keith W. Walker, Lake Zurich, Ill.

[73] Assignee: United States Gypsum Company, Chicago, Ill.

[21] Appl. No.: 935,058

[22] Filed: Aug. 18, 1978

Related U.S. Application Data

[63] Continuation of Ser. No. 802,688, Jun. 2, 1977, abandoned.

[51] Int. Cl.[2] ..... E04C 3/32

[52] U.S. Cl. ..... 52/735; 52/346; 52/393; 29/526 R; 29/155 R

[58] Field of Search ..... 29/526, 155 R; 52/720, 52/735, 346, 364, 393; 248/300

[56] References Cited

U.S. PATENT DOCUMENTS

| | | | |
|---|---|---|---|
| 582,645 | 5/1897 | Heaton | 52/735 |
| 1,845,693 | 2/1932 | Wojciechowski | 248/300 |
| 2,762,597 | 9/1956 | Jaworski | 248/300 |
| 2,792,999 | 5/1957 | Lorentzen | 248/300 |
| 3,090,164 | 5/1963 | Nelsson | 52/346 |
| 3,350,831 | 11/1967 | Miller | 52/393 |
| 3,561,180 | 2/1971 | Wise | 52/735 |

*Primary Examiner*—James L. Ridgill, Jr.
*Attorney, Agent, or Firm*—Glenn W. Ohlson; Robert H. Robinson; Samuel Kurlandsky

[57] ABSTRACT

A resilient sheet metal runner for attaching wallboard to a supporting structure comprising a base attaching flange having a resilient web coextensive therewith and integral with a longitudinal edge thereof with a support portion integral with an opposite edge of the resilient web and a stop flange integral with the opposite edge of the support portion. The base flange is disposed in a first plane, the flexible web is disposed in a second plane at an obtuse angle to that of the base flange and with respect to a third plane represented by the support portion. The stop flange extends at an obtuse angle toward the first plane in a fourth plane which it occupies but is of less width than the resilient web so that it does not extend into the first plane. The resilient web is slotted for increased flexibility and the base attaching flange is provided with laterally offset fastener tabs to space the attaching flange from the supporting structure and thus obtain further improvement in the prevention of transmission of vibrations impinging on the wallboards mounted on the sheet metal runners.

4 Claims, 7 Drawing Figures

RESILIENT RUNNER FOR WALL CONSTRUCTION

This is a continuation of application Ser. No. 802,688, filed June 2, 1977, now abandoned.

BACKGROUND OF THE INVENTION

Wall framing of two by four support members is common in the usual wall or ceiling contructions. In wallboard type of wall and ceiling construction the 2"×4"support members support and are covered by gypsum wallboard which may be a single layer of gypsum wallboard or of two ply construction consisting of a gypsum backing board surfaced with a layer of gypsum wallboard. Such structure is widely used because it is strong, inexpensive and readily fabricated. Its use in apartment buildings and multi-unit constructions has been more or less restricted because of its lower resistance to the transmission of sound and thereby fails to secure the privacy preferred by occupants of such buildings. Attempts have been made to solve this problem and one such method utilizes a staggered stud system. In this system the supporting studs are staggered so that they are spaced and arranged in such manner that alternate support members are coplanar while adjacent support members are offset relative to each other. In the two separate opposed rows of support members one row thus supports the wallboard on one side of the wall while the other row of support members support the wallboard on the other side of the wall. Each side of the wall structure is thus permitted to vibrate independently and therefore substantially independent acoustically. One drawback to such construction is that it requires twice the number of support members normally used and thus results in a substantial increase in expense. Furthermore, this system cannot be adapted for practical applications in ceiling structure.

Another prior method comprises a slotted stud system wherein each support member is slotted along its length, except at its end, to divide the support into two portions separated by a space. This permits the two portions to resonate substantially independently and thus be substantially independent ocoustically. Wallboard is applied to such slotted supports as in the usual partition or wall system. A disadvantage of this slotted stud system is that care must be exercised when applying the wallboard so that the fasteners are not driven through the space between slotted portions into the opposite portion and thus destroy the ability of the two portions to resonate independently. Also, such slotted construction cannot be utilized in ceiling structures.

Resilient metal runners have also been used heretofore, and in one such system a plurality of resilient runners are attached to the support members in spaced relationship and disposed to receive wallboard attached thereto. Each such runner comprises an elongate member of sheet metal provided with a base flange secured to the support members and a support surface element of sufficient width to provide for attachment of the meeting edges of adjoining wallboard panels by suitable fasteners. A resilient portion at one edge of the support surface interconnects the support surface with the base flange and thus serves to space the support surface and the attached wallboard from the support members. A stop flange element was disposed along the opposite edge of the support surface element and extended at an angle toward the support members and served to support the support surface element when the wallboard was being applied thereto as by the driving of fasteners. In this runner, the base flange is directly secured to the support member by suitable fasteners, thus any reduction in the transmission of vibrations is attained solely by the amount of resiliency along the interconnection between the base and support flanges.

SUMMARY OF THE INVENTION

The present invention provides a resilient runner which may be used with wall structures or ceiling constructions, and are such, when installed on the support members, as to provide level coplanar supporting surfaces for application of gypsum boards on the wall and ceiling structures and thus afford smooth surfaces. The resilient runners are spaced apart and since the standard wallboards are four feet in width and spacing of the runners will be about two feet so that the gypsum wallboard can then be applied horizontally or vertically, and thereby take advantage of the flexibility thus afforded in constructing the walls and ceilings. The resilient runners are fully capable of being applied at any desired spacing to utilize wallboards of different widths. Each resilient metal runner, as herein contemplated, comprises an elongate sheet metal runner specifically adapted for attaching wallboard to a supporting structure preferably on both sides thereof, in resiliently spaced relation, so as to prevent sound waves impinging against the wall surfaces from being transmitted directly to the support structure and thus to the opposite wallboard. The vibrations induced in the wallboards will be ultimately dispersed and absorbed so that little, if any, vibration will be transmitted through the support structure. The vibrations are damped and diffused in their travel through the resilient metal runners interposed between the support structure and the wallboard applied on opposite sides thereof. The resilient runner includes a base flange for attaching the runner to support members which can be described as lying in a first plane. A resilient web is integral along one edge with the adjoining edge of the base flange and lies in a second plane at an obtuse angle to the first plane in which the base flange lies. A support portion lying in a third plane inclined with respect to the second plane in which the resilient web lies has one edge coextensive with the opposite edge of the resilient web and extends laterally in an offset position relative to the base flange. The support portion is disposed substantially parallel to the base flange. A stop flange is coextensive with the opposite edge of the support portion and extends outwardly in an inclined plane toward the support members but this flange is shorter than the distance between the support portion and the support members so that the free edge of the stop flange is spaced from the support members. The characterizing improved feature in this resilient runner comprises a series of fastener tabs on the base flange which space the sheet metal runners from the supporting structure and thus further insulate the assembly against transmission of vibrations impinging on the surfaces of the wallboards.

OBJECTS OF THE INVENTION

It is the primary purpose of this invention to provide an improved resilient metal runner for the securement of gypsum wallboard on supporting stud members in a manner to prevent sound waves impinging against the wallboard surfaces from being transmitted directly through the wall structure.

The principal object of the invention is to provide a resilient sheet metal runner having a base flange provided with laterally offset fastening plates for securing the metal runner to supporting structure in spaced relation thereto.

An important object of the invention is the provision of a resilient sheet metal runner having a base flange provided with laterally offset fastening plates in spaced groups at regular interval longitudinally along the base flange for lengthwise adaptability of securement to supporting structure while maintaining a laterally spaced relationship of the runner with respect to such structure.

Another object of the invention is to provide a sheet metal resilient runner including a base flange having a fastening plate for securing the runner to a supporting structure wherein the fastening plate is offset laterally relative to the base flange to maintain the runner in spaced relation to the supporting structure with the fastening plate having a plurality of nail holes to receive a fastening to the supporting structure.

DESCRIPTION OF THE DRAWINGS

The foregoing and other and more specific objects of the invention are attained by the construction and arrangement illustrated in the accompanying drawings wherein.

DESCRIPTION OF PREFERRED EMBODIMENT

Figure 1:
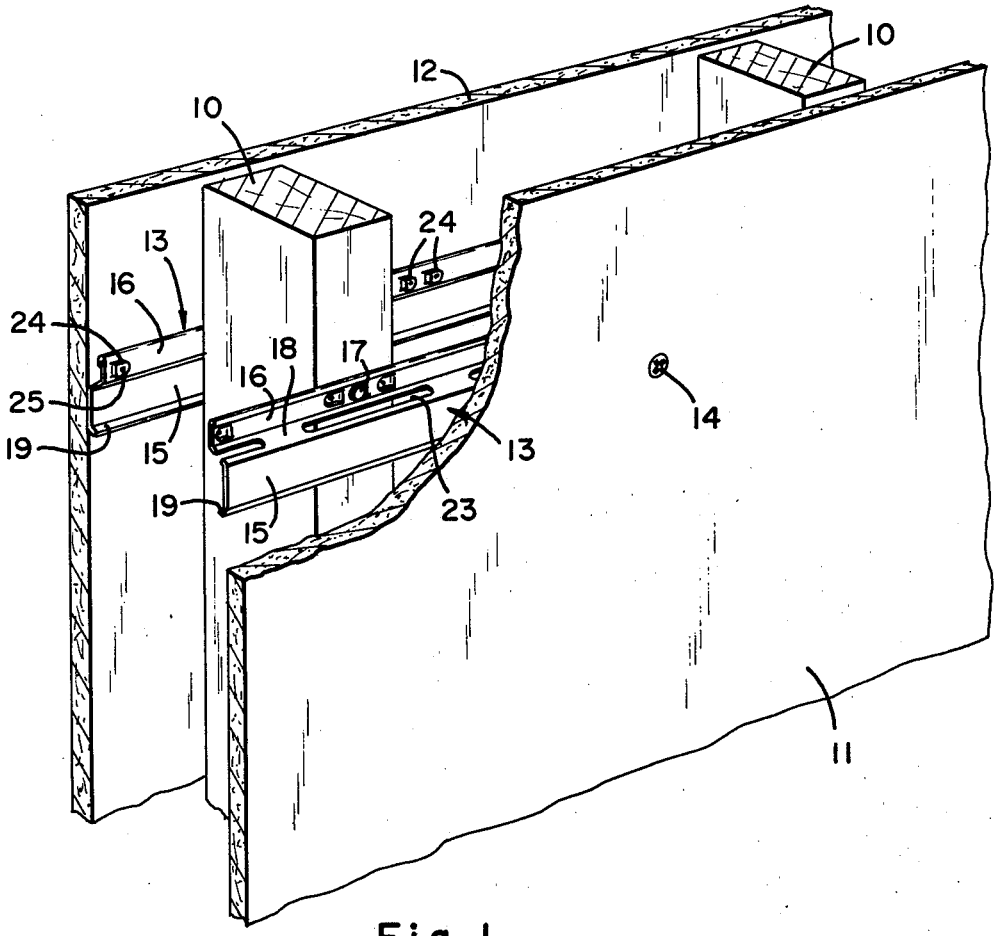
FIG. 1 is a fragmentary general perspective view of a wall structure showing parts in section and portions broken away and wherein gypsum wallboards are shown as being mounted on opposite sides of generally vertical supporting stud members by means of the resilient metal runner of this invention.

In the drawings, as shown in FIG. 1, the construction of the wall illustrated is comprised of a plurality of generally vertically disposed 2"×4" studs or supporting members 10 having gypsum wallboards 11 and 12 mounted upon the opposite sides thereof to form a partition or wall structure. The supporting members 10 of course can be disposed horizontally as in a ceiling structure in which event the gypsum wallboard 11 would be installed upon but one side of the structure at the inside to form the ceiling. The gypsum wallboards 11 and 12 are applied to the supporting members 10 through the medium of resilient metal runners 13 disposed between the respective wallboards 11 and 12 and the supporting members at opposite sides of the members 10.

Only one of the resilient runners 13 is shown at each side of the supports 10 but in an actual structure the runners would be mounted on the supports at regularly spaced intervals throughout the height of the wall structure or throughout the width of a ceiling structure whereby the gypsum wallboards would be properly and resiliently backed up and supported throughout the entire area of a wall or ceiling structure. The gypsum wallboards, in the form shown, are secured to the resilient sheet metal runners 13 by means of screws 14 here illustrated as comprising Phillips type screws which, as indicated, are disposed flush with the surface of the gypsum board and are threaded into a support portion 15 of the metal runner 13 to secure the gypsum board in place. The metal runner 13 is secured to the upright supporting members 10 through a base flange 16 by means of fastenings 17, which are here shown as nails driven through the base flange 16 into each of the supporting members 10 to securely mount the metal runners upon opposite sides of the supporting members in the desired spacing and relationship to support the attached gypsum boards in properly spaced relation.

Figure 2:
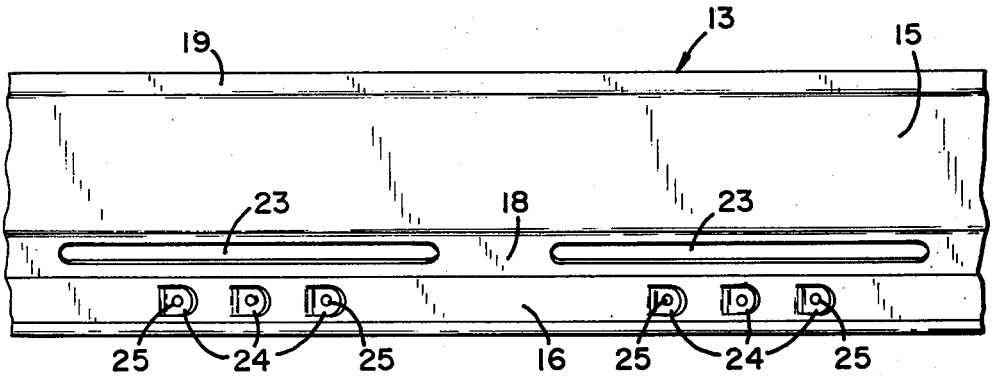
FIG. 2 is an elevational view of one form of the resilient sheet metal runner of this invention.

The resilient sheet metal runner 13 includes a resilient web 18 integral along one continuous edge thereof with the adjoining edge of the base flange 16. The base flange on each runner 13 is disposed in one plane, which as here disclosed, is substantially vertical adjoining the respective faces of the supporting members 10. The resilient web 18 however, lies in a second plane inclined at an obtuse angle to the first plane defined by the base flange. The opposite edge of the resilient web 18 is coextensive with the adjoining edge of the support portion 15 of the metal runner and with which the resilient web is integral. The resilient web 18 may be provided with a series of openings 23 at equally spaced intervals along its length, if desired, whereby further to increase the flexibility of the web by reducing the amount of stiffening metal therein. The openings 23 may comprise a plurality of round holes or, if desired, may comprise a series of lengthwise extending slots, as shown. It is preferable for the equally spaced openings 23 to also be centered about the grouped fastening plates 24 to obtain the desired resiliency at support members 10 as shown by FIGS. 1 and 2. The support portion 15 of the metal runner 13, to which the gypsum board is secured, lies in a third plane which, while parallel to the attached gypsum board, is inclined with respect to the second plane occupied by the resilient web 18 and offset laterally in a position spaced from the supporting members 10 and base flange 16. The supporting portion 15 of the metal runner 13 is, of course, substantially parallel also to the first plane defined by the base flange 16.

A stop flange 19 is integral with and coextensive with the opposite edge of the support portion 15 and is inclined relative to the support portion and extends at an angle toward the first plane represented by the base flange 16 on the supporting members 10 but stops short of the supporting members so that the terminal, or free end of the stop flange is spaced from the members 10 leaving the metal runner 13 free to deflect and to flex as afforded by the resilient web 18 but adapted to contact the supporting members 10 when deflected under the force of driving the fasteners 14 thus preventing the fasteners from being driven into the members 10 and defeating the purpose of the flexibility provided by the runner to absorb vibrations and thereby prevent transmission of sound waves. Upon contact of the free end of the stop flange 19 with the supporting members 10 the support portion 15 of the metal runner will be prevented from further deflection toward the members 10 thereby enabling the screws 14 to be driven through the support portion 15 without penetrating the supporting members.

Figure 3:
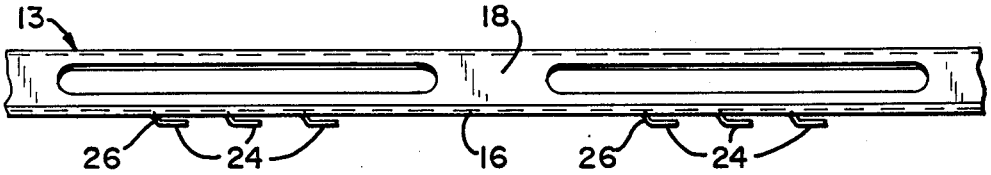
FIG. 3 is a top plan view of the runner.

In the form of the invention illustrated in FIGS. 1, 2 and 3 the sheet metal resilient runner includes structure for securing the base attaching flange 16 to the supporting members 10 in a manner whereby a greater degree of insulation of the supporting structure from vibrations impinging on the surfaces of the gypsum wallboards 11 and 12 is obtained. This structure includes means spaced from the plane of the base attaching flange 16 whereby this flange and the metal runner 13 is secured to the supporting structure in spaced relation from the supporting members 10 thereby to reduce the transmission of such vibrations through the wall structure. The base attaching flange 16 is secured to the supporting members 13 by the fastenings 17 but this securement is by means of offset fastening plates 24, each containing a nail hole 25, through which the fastenings 17 are driven into the supporting members 10.

The fastening plates 24 are displaced laterally from the plane of the base attaching flange 16, as best illustrated in FIG. 3, so that, when installed, the attaching flange is disposed in spaced relation from the supporting members 10 by the amount of the offset represented by the connecting strip 26 extending between the base flange 16 and each of the fastening plates 24. The fastening plates 24 are disposed in groups of three at longitudinally spaced intervals throughout the length of the sheet metal runner 13 so that some lengthwise adjustment of the metal runner may be had in mounting them on the supporting members 10. This spacing of the groups of plates 24 is such as to be compatible with the usual spacing of studs in wall and partition structures which is generally standardized at approximately sixteen inches. However, in the form herein disclosed the groups of fastening plates 24 are spaced on eight inch centers to provide a greater range of adaptability while conforming with the standard stud spacing.

Figure 4:
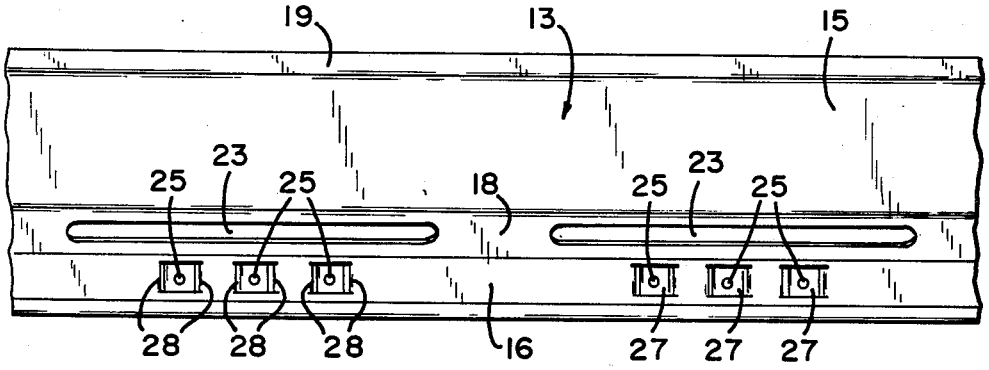
FIG. 4 is an elevational view of another form of the invention.
Figure 5:
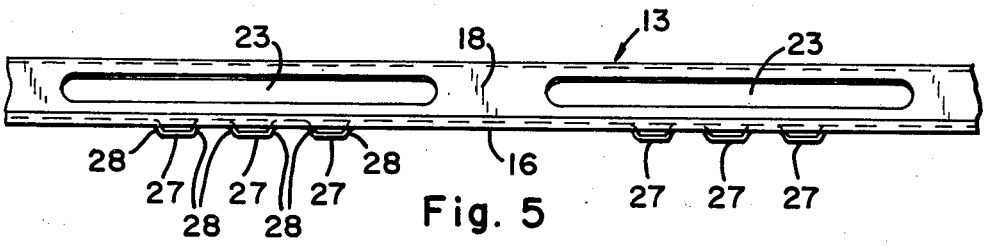
FIG. 5 is a top plan view of the resilient sheet metal runner illustrated in FIG. 4.

In the modified form of the invention illustrated in FIGS. 4 and 5 the general structure of the sheet metal stringer 13 is identical with the form of the metal runner shown in FIGS. 2 and 3, including the base attaching flange 16, the support portion 15, the flexible web 18 internally connecting the base flange and support portion, the openings 23 in the resilient web and the stop flange 19 at the opposite edge of the support portion. The offset fastening plates 27 however, are integrally connected with the base flange 16 at opposite ends of each such plate members by connecting strips 28. The offset plates 27 are disposed in multiples of three at longitudinally spaced intervals similar to the spacing of the spacing tabs 24 in FIGS. 2 and 3 and in the form of the invention shown in FIGS. 4 and 5 the offset plates 27 are each provided with the nail hole 25 for receiving the fastenings 17 attaching the sheet metal runner 13 to the supporting members 10.

Figure 6:
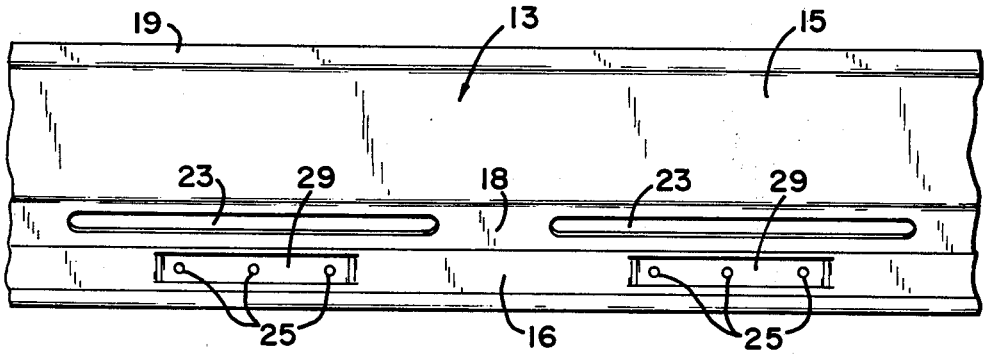
FIG. 6 is an elevational view of still another modification of the sheet metal resilient runner.
Figure 7:
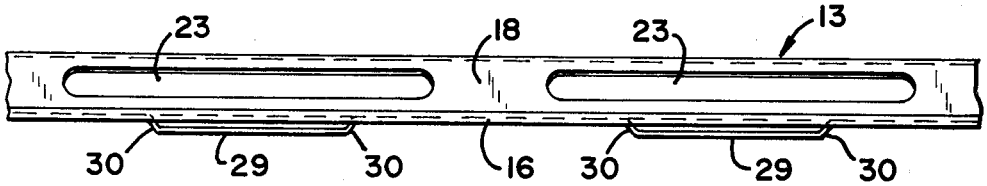
FIG. 7 is a top plan view of the runner arrangement represented by the form illustrated in FIG. 6.

The form of the invention illustrated in FIGS. 6 and 7 is similar to that shown in the preceding Figures, but the offset plates 29 are continuous across each group of three nail holes 25 and are integrally connected at respectively opposite ends of each such continuous plate with the base flange 16 by means of similar connecting strips 30. Otherwise, the arrangement functions in similar manner to the forms of the invention revealed by other Figures. The lateral spacing of the base flange 16 from the supporting member 10 is the same. The capability for adjustment of the sheet metal runners lengthwise is the same and the flexibility of the metal runner 13 to prevent transmission of vibrations impinging on the surfaces of the gypsum wallboards 11 and 12 is the same.

It can readily be appreciated that resilient metal runner 13 may easily be spliced to an adjacent runner, preferably at the connection to a supporting member 10, to provide continuous metal runner of extended length. Adjacent metal runners might also be placed in end-to-end abutting relationship against the supporting members 10 to form a continuous row of metal runner sections.

The invention has been disclosed as applied to typical wooden 2"×4" supporting members in both wall and ceiling structures, but the resilient sheet metal runner of this concept might also be used with other types of construction including metal fabricated supporting members of concrete wall structures.

The embodiment disclosed herein is presently considered to be the preferred form ofthe invention but changes and modifications may be made therein and it is intended that the claims appended hereto shall cover such changes as fall within the scope of this invention.

What is claimed is:

1. A sheet metal resilient runner for the attachment of wallboard to a supporting structure comprising a base flange, a support portion offset laterally from said base flange, a resilient web integral with the base flange and the support portion and extending at an inclined angle therebetween, a stop flange integral with the support portion and extending at an inclined angle toward the plane of said base flange, and a fastening plate offset laterally from said base flange in generally parallel relation thereto and integrally connected to the base flange by a connecting strip extending therebetween.

2. A sheet metal resilient runner as set forth in claim 1, wherein said fastening plate comprises a continuous plate having a plurality of nail holes therein at longitudinally spaced intervals.

3. A sheet metal resilient runner as set forth in claim 1, wherein said fastening plates are disposed in spaced groups disposed at regular intervals longitudinally of said base flange, and a nail hole in each fastening plate for fasteners securing the metal runner to said supporting structure.

4. A sheet metal resilient runner as set forth in claim 3, wherein said fastening plates each have a connecting strip at respectively opposite ends of each plate integrally connecting the plate with said base flange.

* * * * *